US011247081B2

(12) United States Patent
Van Der Zwaan

(10) Patent No.: US 11,247,081 B2
(45) Date of Patent: Feb. 15, 2022

(54) METHOD OF RESCUING A SUBJECT POSITIONED IN A VEHICLE AND A RESCUE DEVICE

(71) Applicant: MODITECH RESCUE SOLUTIONS B.V., Hoogwoud (NL)

(72) Inventor: Paulus Wilhelmus Johannes Maria Van Der Zwaan, Blaricum (NL)

(73) Assignee: PAULUS WILHELMUS JOHANNES MARIA VAN DER ZWAAN, Blaricum (NL)

( * ) Notice: Subject to any disclaimer, the term of this patent is extended or adjusted under 35 U.S.C. 154(b) by 717 days.

(21) Appl. No.: 15/546,159

(22) PCT Filed: Jan. 21, 2016

(86) PCT No.: PCT/EP2016/051229

§ 371 (c)(1),
(2) Date: Jul. 25, 2017

(87) PCT Pub. No.: WO2016/120147

PCT Pub. Date: Aug. 4, 2016

(65) Prior Publication Data

US 2018/0318615 A1 Nov. 8, 2018

(30) Foreign Application Priority Data

Jan. 26, 2015 (EP) ..... 15152559

(51) Int. Cl.

| | |
|---|---|
| ***A62B 35/00*** | (2006.01) |
| ***A62B 3/00*** | (2006.01) |
| ***A61G 1/01*** | (2006.01) |
| ***A61G 1/044*** | (2006.01) |
| ***A61G 7/10*** | (2006.01) |

(52) U.S. Cl.

CPC ..... *A62B 35/0037* (2013.01); *A61G 1/01* (2013.01); *A61G 1/044* (2013.01); *A62B 3/00* (2013.01);

(Continued)

(58) Field of Classification Search

CPC ..... A61F 5/37; A61F 5/3776; A61F 5/3769; A61F 5/3761; A61G 1/044; A61G 1/01;

(Continued)

(56) References Cited

U.S. PATENT DOCUMENTS 2,034,954 A * 3/1936 Murphy ..... A41B 13/065 128/874
3,062,585 A * 11/1962 Bentley ..... A47C 7/42 297/484

(Continued)

FOREIGN PATENT DOCUMENTS

GB 1 485 651 A 9/1977
WO WO 2012/057668 A1 5/2012

OTHER PUBLICATIONS

Novak, Rachel: "Snaps: A Comprehensive Guide"; accessed from https://henssgenhardware.com/snaps-complete-guide/ (Year: 2021).*

(Continued)

*Primary Examiner* — Caitlin A Carreiro
(74) *Attorney, Agent, or Firm* — Birch, Stewart, Kolasch & Birch, LLP

(57) ABSTRACT

A rescue device for moving a subject includes a brace member for securing the arms and the torso of the subject together. The brace member includes a central section, a first lateral section and a second lateral section, and a fastener. The brace member is capable of forming a loop for securing the arms and the torso of the subject together by fastening the first lateral section to the second lateral section with the fastener. A ribbon member pair for moving and/or stabilizing a subject wearing the brace member when said rescue device is in use includes a first ribbon member having a first portion connected to the brace member and a second ribbon member having a second portion connected to the brace member.

4 Claims, 7 Drawing Sheets

(52) U.S. Cl.
CPC ..... *A62B 35/0018* (2013.01); *A62B 35/0043* (2013.01); *A61G 7/1023* (2013.01)

(58) Field of Classification Search
CPC .... A61G 1/003; A61G 7/1023; A61G 7/0504; A61G 7/1051; A61G 3/006; A62B 3/00; A62B 35/0006; A62B 35/0018; A62B 35/0037; A62B 35/0043; A62B 35/00; A62B 35/0012; A62B 35/0068; A47C 17/80; B60R 22/14
USPC .... 128/869, 870, 872, 875, 876; 5/625–628, 5/630; D29/101, 101.1, 101.3, 101.4, D29/124; 482/43; 297/464, 465, 468, 297/485; 182/3
See application file for complete search history.

(56) References Cited

U.S. PATENT DOCUMENTS 4,422,454 A 12/1983 English
4,948,192 A * 8/1990 Sohne ..... B60J 11/08 160/370.21
5,839,965 A * 11/1998 Mullins ..... A47D 15/006 472/118
7,225,484 B1 * 6/2007 Ortiz ..... A47D 15/008 128/872
7,360,543 B1 * 4/2008 Coleman ..... A61F 5/3769 128/869
2007/0272484 A1 11/2007 Helms
2011/0120295 A1 * 5/2011 Carter ..... A45F 3/06 89/36.05
2015/0360062 A1 * 12/2015 Oliver ..... A62B 35/0025 182/8

OTHER PUBLICATIONS

International Search Report (PCT/ISA/210) issued in PCT/EP2016/051229, dated May 13, 2016.
Written Opinion (PCT/ISA/237) issued in PCT/EP2016/051229, dated May 13, 2016.

* cited by examiner

METHOD OF RESCUING A SUBJECT POSITIONED IN A VEHICLE AND A RESCUE DEVICE

FIELD OF THE INVENTION

The invention is in the field of rescue devices for taking out a subject seated in the cabin of a vehicle of said cabin.

BACKGROUND OF THE INVENTION

In a vehicle, for example a car or a truck, a subject can get trapped within the cabin after a collision of the vehicle. In such circumstance, the cabin is usually deformed due to the collision and the subject to be rescued may be unconscious in a position wherein a path to get said subject out of the vehicle is blocked.

U.S. Pat. No. 7,360,543 discloses a patient assist lift (PAL) device which enables rescuers to lift and mobilize an injured person and reduces or eliminates risks of injury said rescuers or injured person during mobilization. The PAL comprises ergonomic handles and straps.

A problem is that the rescuers do not have much room to operate within the cabin, making it hard for them to maneuver the subject's body when taking said subject's body out of the cabin.

It is an object of the invention to alleviate the above mentioned problem.

SUMMARY OF THE INVENTION

A first aspect of the invention relates to a method of rescuing a subject positioned in a vehicle, wherein a rescue device is used for moving the subject, the rescue device comprising:

i) a brace member for securing the arms and the torso of the subject together, the brace member comprising
  i. a central section for holding the back of a subject when in use;
  ii. a first lateral section extending from the central section; and
  iii. a second lateral section extending from the central section opposite to the first lateral section; and
  iv. fastening means;

wherein said brace member is capable forming a loop for securing the arms and the torso of the subject together by fastening the first lateral section to the second lateral section with the fastening means, the loop defining a longitudinal direction and a perimeter, and wherein said fastening means is capable of adjusting the perimeter of the loop; and ii) a ribbon member pair for moving and/or stabilizing the subject wearing the brace member, the ribbon member pair comprising
  i. a first ribbon member having a first portion connected to the brace member; and
  ii. a second ribbon member having a second portion connected to the brace member;

wherein the first ribbon member and the second ribbon member both comprise anchoring means for anchoring the first ribbon member and the second ribbon member to a fixed element of the cabin of the vehicle; and wherein the method comprises the steps of placing the rescue device between the subject and the backrest of the seat such that the central section of the brace member is facing the back of the torso of the subject;

fastening the first lateral section and the second lateral section together by the fastening means to form the loop extending in the longitudinal direction along the torso of the subject to secure the arms and the torso of said subject together; and moving and/or stabilizing the subject by pulling at least one of the first ribbon member and the second ribbon member of the ribbon member pair in a direction transverse to the longitudinal direction of the loop;

wherein the method comprises the step of stabilizing the subject by anchoring said anchoring means to a fixed element of the vehicle.

A second aspect of the invention relates to a rescue device for moving a subject in a vehicle comprising i) a brace member for securing the arms and the torso of the subject together, the brace member comprising
  i. a central section for holding the back of a subject when in use;
  ii. a first lateral section extending from the central section; and
  iii. a second lateral section extending from the central section opposite to the first lateral section;
  iv. fastening means; and wherein said brace member is capable forming a loop for securing the arms and the torso of the subject together by fastening the first lateral section to the second lateral section with the fastening means, the loop defining a longitudinal direction and a perimeter, and wherein said fastening means is capable of adjusting the perimeter of the loop; and ii) a ribbon member pair for moving and/or stabilizing a subject wearing the brace member, the ribbon member pair comprising
  i. a first ribbon member having a first portion connected to the brace member; and
  ii. a second ribbon member having a second portion connected to the brace member;

wherein the first ribbon member and the second ribbon member both comprise anchoring means for anchoring the first ribbon member and the second ribbon member to a fixed element of the cabin of the vehicle wherein the first ribbon member and the second ribbon member also comprise means for adjusting the length of said first ribbon member and second ribbon member between the anchoring means and the corresponding first portion and second portion; and means to detach said ribbon members from the brace member.

DETAILED DESCRIPTION OF THE INVENTION

A first aspect of the invention concerns a method for rescuing a subject positioned in a vehicle according to claim 1. The method makes use of a rescue device as recited in claim 1.

A subject present in the cabin of a vehicle in a first position, for instance a position incurred by an accident, in general a seated position, can be maneuvered by rescuers using the rescue device, even when said rescuers are outside said cabin. Once the rescue device is placed between the subject and the backrest of the seat, the brace member of the rescue device is formed in a loop, in general having cylindrical shape, by fastening the first lateral section and the second lateral section of the brace member. In this way, the loop defines a longitudinal direction along which the arms and the torso of the subject are wrapped together to secure them. Then, said subject can be moved from the first position to any desired second position by pulling at least one of the first ribbon member and the second ribbon member of the ribbon member pair. For example, said subject can be moved forward to keep his torso and arms away from the backrest of the seat wherein said subject is seated if said backrest is to be cut off. Alternatively or additionally, the subject can be moved laterally to keep said subject away from a door to be cut off. Besides, once the subject has been moved to the second position, the arms and the torso of said subject can be stabilized, meaning that the subject's body remains in said second position, for example by continuously pulling at least one of the ribbon members. Further, in the method the first ribbon member and/or the second ribbon member may extend through the openings of the windows of the vehicle and consequently the rescuers need not have to operate within the cabin to move the subject to and/or to stabilize the arms and the torso of the subject in the second position. In order to better control the movement and/or stabilization process, it is preferred to pull both ribbon members at the same time.

Since the loop of the brace member secures the arms and the torso of the subject together, the risk of movement of the arms relative to the torso when the subject is being moved is reduced. Thus, the subject may be moved easily because the risk of bumping of said arms against different elements present in the cabin is reduced. Further, when the subject's body is stabilized in the second position, the risk of injuring said subject is also reduced when an element of the cabin, for example the backrest or the door needs to be cut off.

The ribbon members work as a ribbon member pair, allowing for a controlled movement of the subject wearing the rescue device. In general, the first portion and the second portion of the ribbon members are symmetrically connected to the brace member with respect to a plane of symmetry in the longitudinal direction of the loop.

It is preferred that the first lateral section and the second lateral section comprise the fastening means and that the first ribbon member and the second ribbon member are hingedly connected to the central section of the brace member for pivoting said ribbon members about the longitudinal direction of the loop. In this way, the load that the ribbon members apply to the brace member when the subject is being pulled to the second position and/or stabilized in said second position is mainly applied to the central section, and the risk of accidentally opening of said fastening means is reduced. Fasteners such as hook and loop (i.e. Velcro™ brand fasteners) may advantageously be used, which allows for a cheap, quick and easy fastening of the first lateral section and the second lateral section.

The at least one of the first ribbon member and the second ribbon member of the ribbon member pair comprises anchoring means and the method comprises the step of stabilizing the subject by anchoring said anchoring means to an element of the vehicle. In this way, the torso and arms of the subject can be stabilized in any second position without a continuous active pulling of said ribbon member by the rescuers. The anchoring means is capable of anchoring the at least first ribbon member or the second ribbon member to a fixed element of the cabin, for example the steering wheel, an air conditioning diffusor or grid or a handler present in a door.

Preferably, the ribbon member comprising the anchoring means may comprise means to adjust the length of said ribbon member between the anchoring means and the corresponding section of said ribbon member connected to the brace member, for example a fastening belt or an adjuster. The anchoring means can be anchored after moving the subject to the second position. It is also possible to anchor the ribbon member first and to move the subject to the second position by decreasing the length of said ribbon member. Further, the ribbon member comprising the anchoring means may also comprise means to detach said ribbon member from the brace member.

In general both the first ribbon member and the second ribbon member of the ribbon member pair comprise anchoring means.

In an embodiment, the rescue device comprises a further ribbon member pair for moving and/or stabilizing the subject wearing the brace member, the further ribbon member pair comprising i) a third ribbon member having a third portion connected to the central section of the brace member; and ii) a fourth ribbon member having a fourth portion connected to the central section of the brace member;

wherein in the step of placing the rescue device between the subject and the backrest of the seat, the third ribbon member and the fourth ribbon member are respectively arranged around each of the shoulders and subsequently under the underarms of said subject; and wherein said subject is moved by pulling the further ribbon member pair. In this way, the load is mainly applied to the shoulders when the ribbon members of the further ribbon member pair are being pulled during the rescue. Consequently, the risk of accidentally opening the fastening means of the brace member is reduced. Besides, it is possible to pull the subject out of the car through a window of the vehicle, in general the rear window, and the risk of sliding the brace member along the torso and pressing the throat causing suffocation of the subject is also reduced. In general, when the person is being pulled out of the vehicle, a rigid board may be placed under the back of the subject already wearing the rescue device in order to facilitate the rescue.

In general, the third portion and the fourth portion of the further ribbon member pair are symmetrically connected to the brace member with respect to a plane of symmetry in the longitudinal direction of the loop. The ribbon members of the further ribbon member pair have a length allowing for extending said ribbons around the shoulders and under the underarms and also to allow the rescuers to pull the subject out of the vehicle, for example from the rear window and/or when said rescuers are outside the vehicle.

A second aspect of the invention relates to a rescue device according to claim 3. The brace member of the rescue device in general is made of a cloth or sheet comprising a material that is both flexible and resistant to shear stress, such as woven fabric, woven polymer, leather, plastic, rubber, etc. Consequently, the brace member can easily be placed in position and the loop is easily formed. The material may preferably comprise a fire resistant material, for example aramid fibers, such as Nomex.

In this aspect, the term flexible means that said brace member is capable of adapting to the shape of the subject's torso and arms together. Thus, the rescue device may be placed very easily even if there is not much room between the subject and the seat where the subject is. The brace member may also be reinforced to avoid undesirable movement of the subject. Reinforcement may for instance be effectuated by a rigid member that may be placed within a pocket of the brace member. The rigid member may be a panel and/or one or more stripes comprising a metal or a rigid polymer. The rigid member is more rigid than the brace member. It is preferred that the rigid member is in the central section of the brace member to reduce injury to the spine of the subject, to facilitate the placement of said rescue device between the subject and the backrest of the seat and/or to facilitate the movement of said subject.

The term resistant to shear stress means that said brace member is capable of supporting the weight of a subject of at least 80 kg, preferably at least 100 kg and more preferably at least 120 kg, preferably without deformation of the brace member.

In order to form the loop, the first lateral section and the second lateral section are fastened together by any fastening means known in the art. When the loop is formed, the first lateral section and the second lateral section may or may not overlap. When said first lateral section and second lateral section do not overlap, the fastening means forms part of said loop. Since the brace member has to be capable of adapting to the size of different people, the diameter of the loop is adjustable, which is achieved by the fastening means, for example when the fastening means comprises an adjuster.

In the present invention a ribbon member may be any strip, string, rope or ribbon capable of pulling and/or stabilizing the subject wearing the brace member. The ribbon members are also made of a material that is both flexible and resistant to shear, making them bendable in different directions and allowing said ribbon members to be pulled in different directions and/or at different angles. The ribbon members may comprise any adjuster known in the art to reduce their length, although at full length they are in the range of 60-120 cm, preferably between 70-100 cm and more preferably about 80 cm long.

The first ribbon member and the second ribbon member are respectively connected to the brace member at a first portion and at a second portion. The first and the second portions may be fixed directly to the brace member, for example if the ribbons members are sewn to the brace member. Alternatively, the first portion and second portions may be fixed to the brace member via an element, such as a flap or a ring, provided in the brace member. In a different embodiment, the first ribbon member and the second ribbon member may be detachably connected to said brace member by any means known in the art, for example by a buckle or by a guiding section on the brace member receiving the ribbon member.

The first portion of the first ribbon member and the second portion of the second ribbon member may be the same, i.e. may overlap, meaning that the first ribbon and the second ribbon are connected together to the brace member. It is also possible that the first ribbon member and the second ribbon member form a single ribbon member. Such a single ribbon member is preferably detachably connected by using guiding sections on the brace member that receive the single ribbon member.

The at least one of the first ribbon member and the second ribbon member comprises anchoring means for securing the at least one of the first ribbon member and the second ribbon member. In this way, the ribbon member comprising the anchoring means can be anchored to provide stability to the subject wearing the rescue device. Anchoring means can be any known in the art, for example a carabiner. Preferably, the ribbon member comprising the anchoring means also comprises means for adjusting the length of said ribbon member between the anchoring means and the corresponding portion at which said ribbon member is connected to the brace member. Then it becomes possible to pull and/or stabilize the subject wearing brace member by reducing the length of said ribbon once the anchoring means has been anchored. It is preferred that the anchoring means is a hook, since it can be anchored/unanchored in a relatively fast and easy way.

In an embodiment, i) the first lateral section and the second lateral section comprise the fastening means; and ii) the first portion of the first ribbon member and the second portion of the second ribbon member are connected to the central section of the brace member.

In this way, the load that the ribbon members apply to the brace member when the subject is being pulled in a direction transverse to the longitudinal of the loop is mainly applied to the central section of said brace member, and the risk of accidentally opening of said fastening means is reduced.

In an embodiment, the first portion and the second portion of the first and the second ribbon members are hingedly connected to the brace member for pivoting said ribbon members about the longitudinal direction of the loop. In this way, the first ribbon member and the second ribbon member can be pivoted about the longitudinal direction of the loop when being pulled and/or stabilized, for example by a ring attached to the brace member to which the first portion or the second portion of the corresponding ribbon member is connected, and the tension that the ribbon members may cause to the fastening means is even more reduced. This is specially advantageous when the fastening means comprises Velcro that allows for fastening and for adjusting the perimeter of the loop in a single step. It is preferred that said ribbon members are hingedly connected by flap sections, each flap section providing a strong attachment to the brace member.

In an embodiment, the first ribbon member and/or the second ribbon member are respectively detachably connected to the brace member. In this way the brace member can be freed from a ribbon member, for example because said ribbon member is anchored by the anchoring means or have been trapped during the rescue with an element present in the cabin. Preferably, the ribbons are detachably connected at the flap sections.

In an embodiment the rescue device comprises a further ribbon member pair for moving and/or stabilizing a subject wearing the brace member, the further ribbon member pair comprising i) a third ribbon member having a third portion connected to the central section of the brace member; and ii) a fourth ribbon member having a fourth portion connected to said central section of the brace member.

wherein the third ribbon member and the fourth ribbon member are connected to the central section closer to the perimeter of the loop, when said loop is formed, than the first ribbon member and the second ribbon member. In this way, the upper part of the back of the torso of the subject being rescued can be held and/or easily directed when being moved in a direction parallel to the longitudinal of the loop, which is advantageous when said subject is being pulled out of the vehicle, e.g. through the rear window. It is preferred that the third ribbon member and the fourth ribbon member form a single ribbon member connected by a guiding section provided in the central section of the brace member, the guiding section extending along the longitudinal direction of the loop formed when the rescue device is in use. In this way, the tension that the rescue device may cause to the neck of the subject when in used is also reduced.

The further ribbon member pair may comprise any feature already discussed for the ribbon member pair. The full length of the third ribbon member or fourth ribbon member is in the range of 150-200 cm, preferably between 160-180 cm and more preferably about 170 cm.

The present invention also envisages a combination of the previous mentioned embodiments. The rescue device according to the invention may also comprise any combination of features discussed in the method and vice-versa.

BRIEF DESCRIPTION OF THE DRAWINGS

For the purpose of illustrating the invention, the drawings show aspects of one or more embodiments of said invention. However, it should be understood that the present invention is not limited to the precise arrangements and instrumentalities shown in the drawings, wherein.

DETAILED DESCRIPTION OF THE DRAWINGS

It should be noted that items which have the same reference numbers in different figures, have the same structural features and the same functions. Where the function and/or structure of such item has been explained, there is no necessity for repeated explanation thereof in the detailed description.

It should also be noted that the above-mentioned embodiments illustrate rather than limit the invention, and that those skilled in the art will be able to design many alternative embodiments.

Figure 1A:
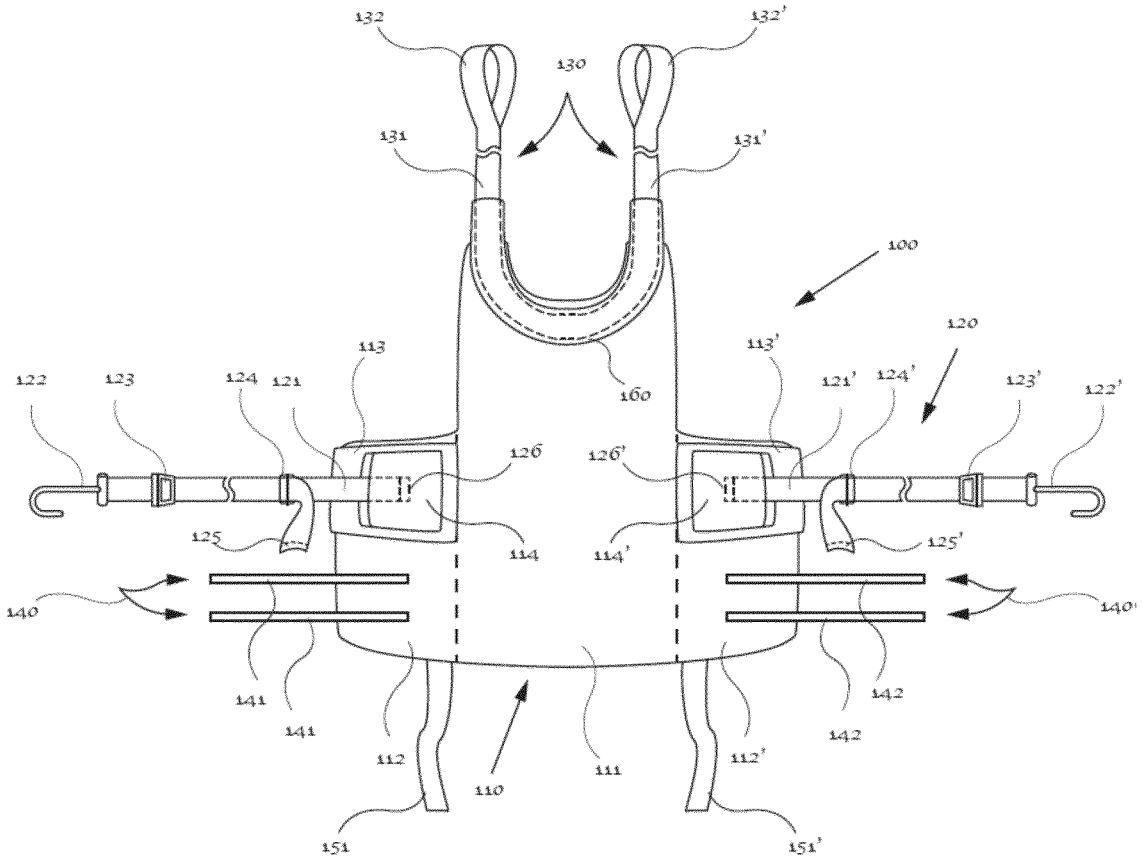
FIG. 1A shows a view of the rescue device shown in a unfolded state.
Figure 1B:
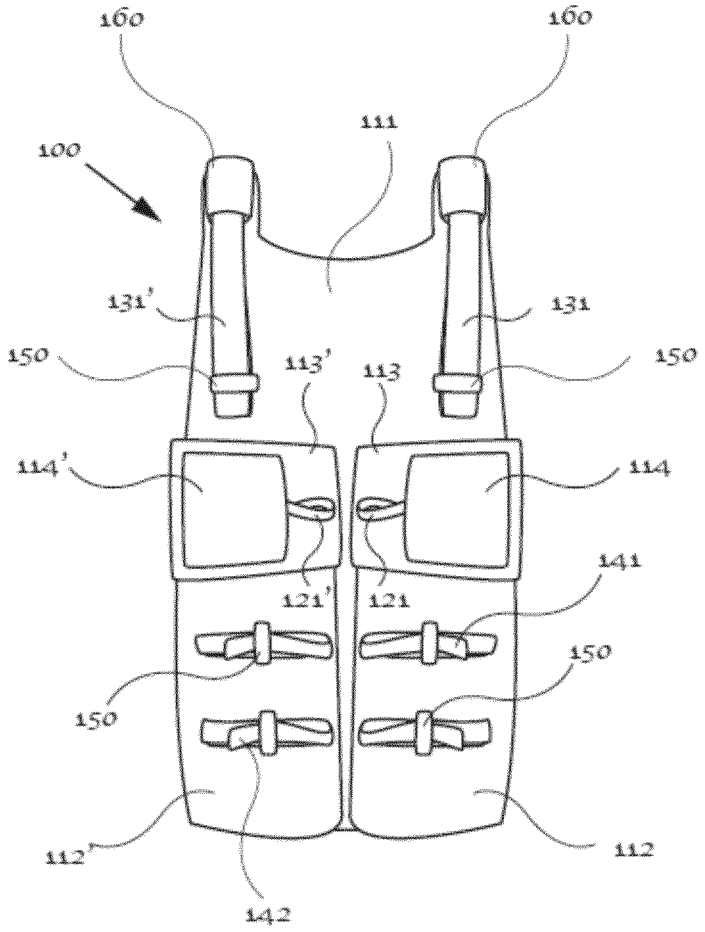
FIG. 1B shows a view of a rescue device depicted in FIG. 1A in an partially folded state.

FIG. 1A and FIG. 1B depict a rescue device 100 according to the invention. FIG. 1A shows the rescue device 100 in an unfolded state. The rescue device 100 comprises a brace member 110, a ribbon member pair 120 and a further ribbon member pair 130 and fastening means 140.

In the present example, the brace member 110 is a cloth comprising a central section 111, a first lateral section 112 and a second lateral section 112'. Both lateral sections extend from the central section 111 in opposite directions. The brace member 110 is made of aramid fibers, for example Nomex™, for providing heat-resistance, flexibility and strength.

As shown in FIG. 1A, the ribbon member pair 120 comprises a first ribbon member 121 and a second ribbon member 121', in the present example a first ribbon 121 and a second ribbon 121' respectively. The first ribbon 121 comprises a free end 125 and a first portion 126 at which said first ribbon 121 is connected to a first flap section 113 sewn to the central section 111 of the brace member 110. Similarly, the second ribbon 121' comprises a free end 125' and a second portion 126' at which said second ribbon 121' is connected to a second flap section 113' sewn to the central section 111. In this example both the first ribbon 121 and the second ribbon 121' are made of woven polyamide for providing flexibility and strength to said ribbons. The function of the flap sections 113 and 113' will be explained later.

The first ribbon 121 comprises anchoring means 122, in the present example a hook 122. The first ribbon 121 also comprises means 123 for detaching the hook 122 from the first flap section 113, in the present example a buckle 123, and means 124 for adjusting the length between the first portion 126 and the hook 122, in the present example an adjuster 124. The means 123 and 124 are known in the art. Similarly, the second ribbon 121' also comprise a hook 122', buckle 123', and an adjuster 124'. The full length between the corresponding anchoring means and the portion in each ribbon is in the range of 60-120 cm, preferably between 70-100 cm long, and more preferably about 80 cm. The full length can be reduced by the adjusters 124 and 124'.

The central section 111 comprises a further ribbon member 130. In the present example the further ribbon member 130 is a single ribbon member comprising a handler 132 and 132'. The single ribbon member is made of woven polyamide for providing flexibility and strength and the length is in the range of 150-200 cm, preferably between 160-180 cm and more preferably about 170 cm.

The further ribbon member 130 is connected to the central section 111 of the brace member 110 by a guiding section 160. The guiding section 160 defines for the further ribbon member 130 a single portion 160 at which said further ribbon member is connected to the central section. The portion of the single ribbon member between the single portion 160 and the handler 132 defines a third ribbon member 131. Similarly, the section of the single ribbon member between the single portion 160 and the handler 132' defines a fourth ribbon member 131'.

As shown in FIG. 1A, the fastening means 140 comprises strips 141 sewn to the first lateral section 112 and strips 142 sewn to the second lateral section 112'. The strips 141 and the strips 142 are provided with Velcro portions to fasten them together when the device is in use.

The rescue device 100 also comprises a first strip 151 sewn to the first lateral section 112 and a second strip 151' sewn to the second lateral section 112'. The function of said strips will be explained later.

The rescue device 100 may be kept in a folded state as shown in FIG. 1B. In the folded state the first lateral section 112 and the second lateral section 112' can be folded with respect to the central section 111 since the cloth defining the brace member 110 is flexible. In the folded state the first ribbon 121 and second ribbon 121' are packed within pockets 114 and 114' present in the flap sections 113 and 113' respectively; the third ribbon 131 and the fourth ribbon 131' are kept in a rolled state by strips 150 and the strips 141 and 142 are kept in a rolled state by strips 150 present in the first lateral section 112 and second lateral section 112'.

FIGS. 2 to 6 show the steps of an example of a method of rescuing a subject from the interior of a vehicle 290 after an accident, the method using the rescue device 100 shown in FIGS. 1A and 1B. In the present example, the subject is seated in front of the steering wheel 295 in a first position. Said subject is, for example, going to be rescued via a path through a hatch generated by removing the rear window (not shown). In order to free the path, the backrest 271 of a seat 270 where said subject is placed has to be removed, in the present example by cutting said backrest 271 off at the bottom side thereof.

Figure 2:
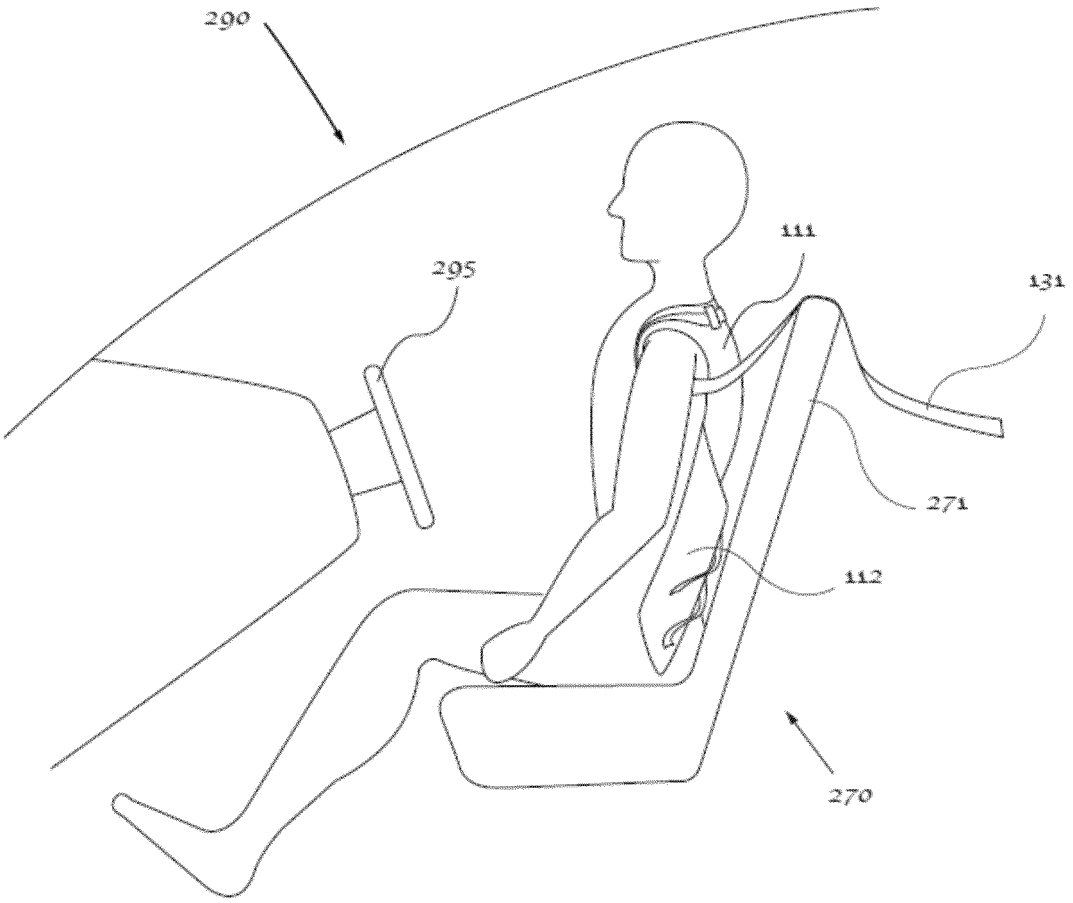
FIG. 2 shows a side view of a subject to be rescued in a vehicle, wherein the rescue device shown in FIG. 1 is placed between the backrest and the subject's back.

As shown in FIG. 2, the rescue device 100 is placed between the torso of the subject and the backrest 271 such that the central section 111 of the brace member 110 is facing the back of the torso, and the third ribbon 131 and the fourth ribbon 131' are slung over the shoulders. In order to make it more easy, all the ribbons are in the folded state. Besides, if there is not much room between the back of the subject and the backrest 271, the rescuers may pull down the rescue device by pulling downward from the strips 151 and 151'. Then, said third ribbon 131 and fourth ribbon 131' are unrolled and extended over the shoulders and subsequently under the underarms of said subject. Finally, the third ribbon 131 and fourth ribbon 131' are positioned over the top of the backrest 271 towards the rear window of the car 290.

Figure 3:
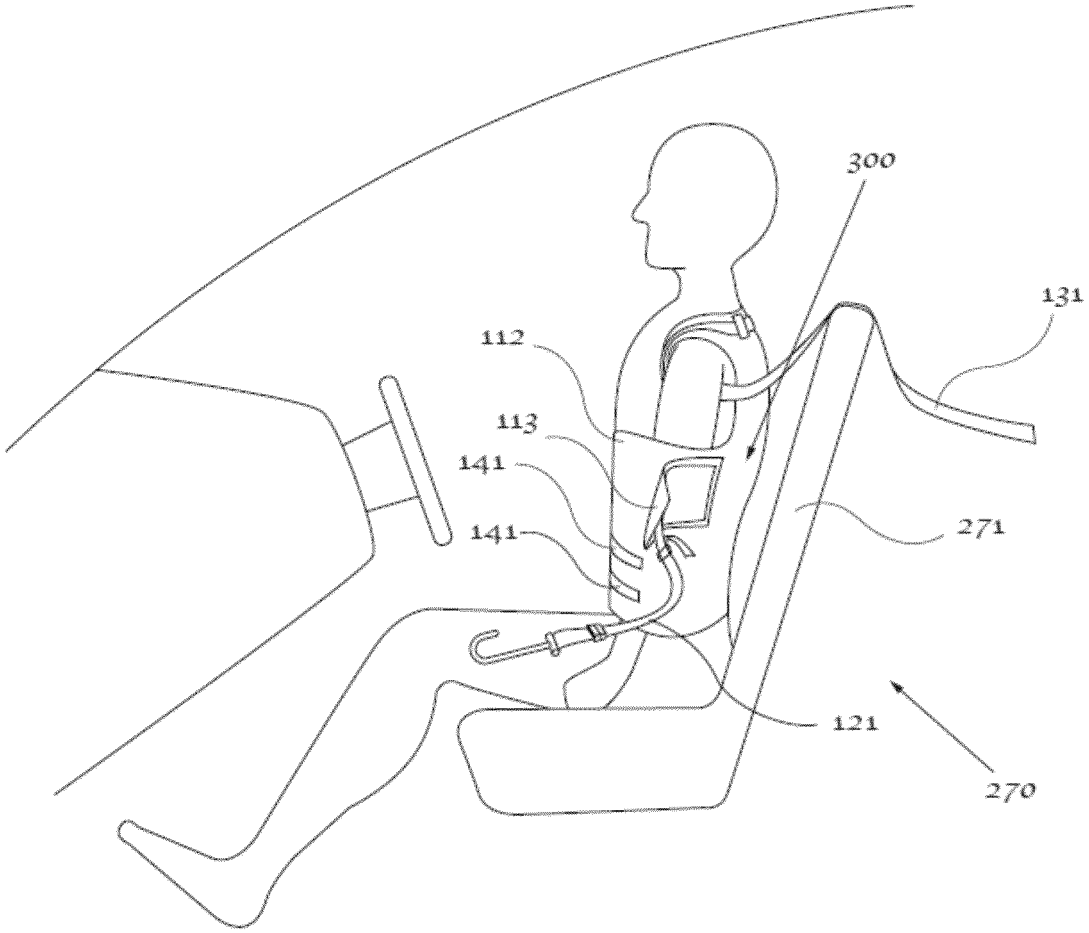
FIG. 3 shows a side view of the subject wherein the rescue device is fastened to secure the arms and the torso of the subject together.
Figure 4:
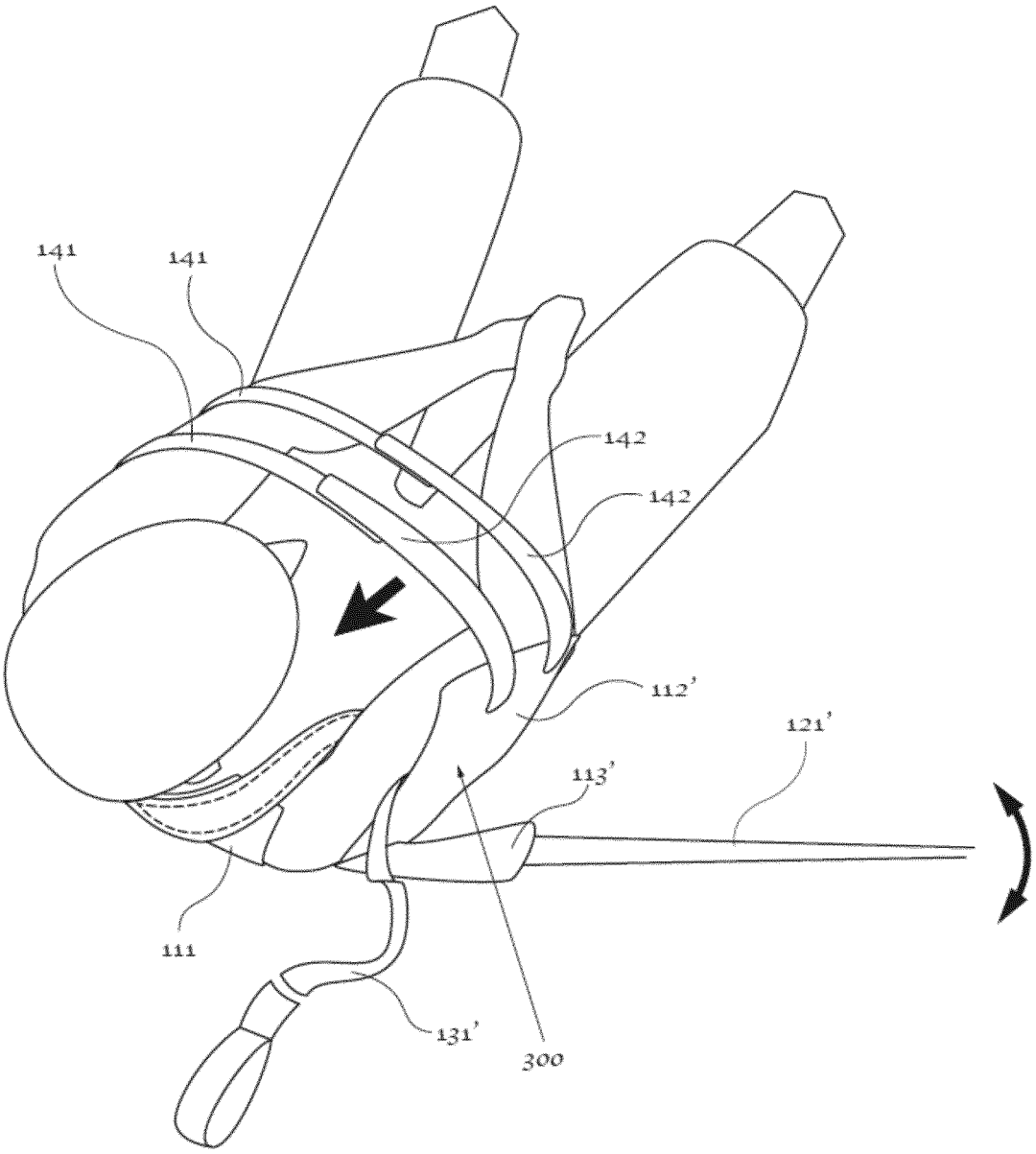
FIG. 4 shows a perspective top view of a flap section present in the rescue device.

FIGS. 3 and 4 depict a loop 300 formed subsequently when the first lateral section 112 and the second lateral section 112' are fastened to each other by fastening the strips 142 to the strips 141. The loop 300 secures the arms and the torso of the subject together, preventing the arms from moving relatively to the torso.

The flap sections 113 and 113' are hingedly connected to the central section 111. FIG. 4 shows the capability of the flap section 113' to pivot about the longitudinal direction of the loop 300. Therefore, the second ribbon 121' can pivot without applying tension to the fastening means 140. The same effect is to be acknowledged to the flap section 113 and the first ribbon 121.

Figure 5:
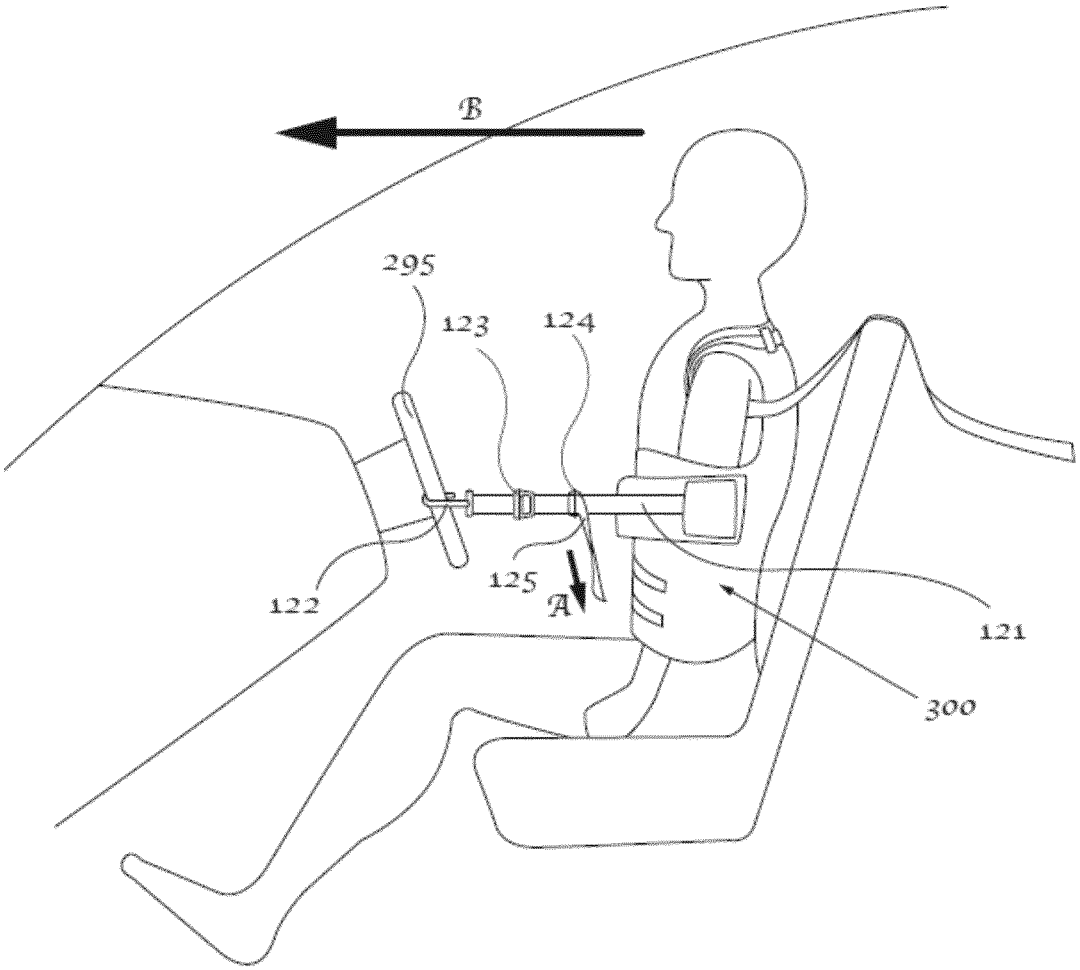
FIG. 5 shows a side view of the subject stabilized in a second position by the rescue device

FIG. 5 depicts a further state wherein the subject wearing the rescue device 100 is moved and stabilized in the second position. In the present example, the first ribbon 121 and the second ribbon 121' are extending out of the pockets 114 and 114' respectively. The first ribbon 121 and the second ribbon 121' are anchored respectively by using the hooks 122 and 122' in this example to the steering wheel 295 and to an air conditioning diffusor (not shown) present in the car 290. Then, by pulling the free ends 125 and 125' of the first ribbon 121 and second ribbon 121' along a direction A, the full length in each of said ribbons between the corresponding anchoring means and the portion is reduced thanks to the means 124 and 124', moving the arms and the torso of the subject along a direction of arrow B, in the present example towards the steering wheel. Therefore, the torso and the arms are relatively far from the backrest 271 than in the first position. In this scenario, the backrest 271 can be cut off reducing the possibility of injury said subject and there is no need for a rescuer to keep said subject in the second position. Further, since the flap sections 113 and 113' are sewn to the central section 111, the tension applied to the fastening means 140 is also reduced when the subject is being moved and/or stabilized.

Figure 6:
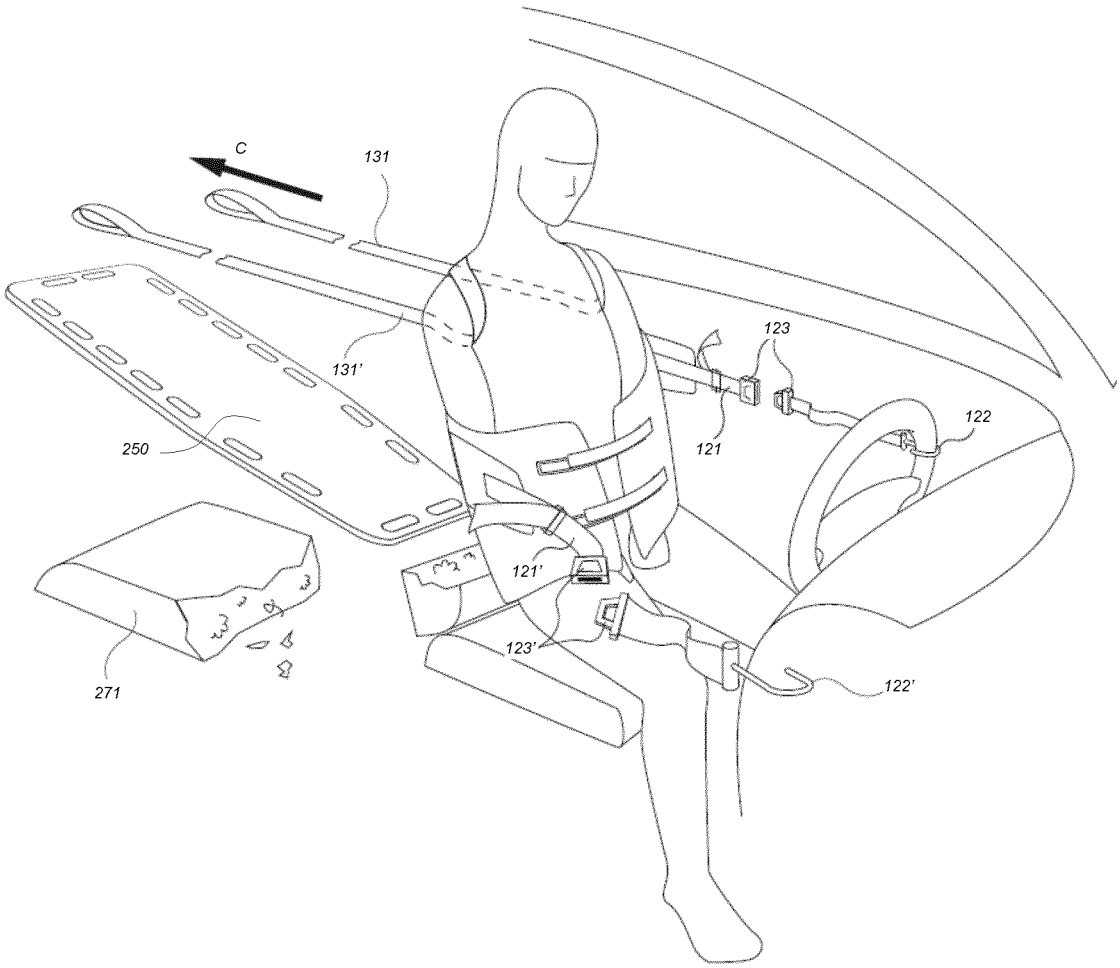
FIG. 6 shows a view of the subject when the backrest of the seat is removed and the subject is prepared to be pulled out of the vehicle.

FIG. 6 depicts the last state of the method according to the present example. Once the backrest 271 has been cut off, the rescue path is free for transporting the subject, for example by placing a rescue board 250 near the bottom part of the subject's back. Then, the hook 122 of the first ribbon 121 and the hook 122' of the second ribbon 121' are detached from the brace member 110 by using the buckles 123 and 123' while a rescuer is holding the subject. Finally, said subject is pulled out through a rear window (not shown) by pulling the third ribbon 131 and the fourth ribbon 131' of the further ribbon member pair 130 along the direction of arrow C. In this situation, the handlers 132 and 132' are used to apply tension for moving the subject.

The present invention may be varied within the scope of the appending claims. For example, in the method the subject, after being stabilized by means of the first ribbon 121 and second ribbon 121' in the second position, may be rescued out of the vehicle via a path that extends lateral to the direction of arrow C, for example after a door has been removed or via a lateral window.

The invention claimed is:

1. A rescue device for moving a subject in a vehicle comprising:

a brace member for securing the arms and the torso of the subject together, the brace member comprising:

a central section for holding the back of the subject when in use;

a first lateral section extending from the central section;

a second lateral section extending from the central section opposite to the first lateral section; and a fastener;

wherein the first lateral section and the second lateral section comprise the fastener, wherein the brace member is configured to form a loop defining a longitudinal direction and a perimeter wherein the loop is configured to extend in the longitudinal direction along the torso of the subject for securing the arms and the torso of the subject together by fastening the first lateral section to the second lateral section with the fastener; and a ribbon member pair for moving and/or stabilizing the subject while wearing the brace member when said rescue device is in use, the ribbon member pair comprising:

a first ribbon member having a first end connected to the brace member and extending in a lateral direction of the central section;

a second ribbon member having a first end connected to the brace member and extending in the lateral direction of the central section;

wherein the first end of the first ribbon member and the first end of the second ribbon member are connected to the central section of the brace member, a further ribbon member pair for moving and/or stabilizing the subject while wearing the brace member, the further ribbon member pair comprising:

a single ribbon member comprising opposing first and second free ends and having a first handler at the first free end and a second handler at the second free end, wherein the single ribbon member is connected to the central section of the brace member by a u-shaped guiding section provided along an uppermost perimeter edge of the central section wherein the u-shaped guiding section defines a single portion at which said further ribbon member pair is connected to the central section, wherein a portion of the single ribbon member between the single portion and the first handler defines a third ribbon member extending in a longitudinal direction of the central section; and wherein a portion of the single ribbon member between the single portion and the second handler defines a fourth ribbon member extending in a longitudinal direction of the central section, a hook at a second end of each of the first and second ribbon members, said hook being dimensioned for anchoring the first ribbon member and the second ribbon member to a steering wheel in a cabin of a vehicle, wherein the first ribbon member and the second ribbon member are each adjustable in length by an adjuster and detachably connected to the brace member by a buckle, wherein a full length of each of the first and second ribbon members, measured between the hook and the first end of each of the first and second ribbon members is in the range of 60-120 cm, wherein the first ribbon member comprises a first portion and the second ribbon member comprises a second portion, wherein the first portion of the first ribbon member and the second portion of the second ribbon member are hingedly connected to the brace member for pivoting each of said first and second ribbon members about the longitudinal direction of the loop.

2. The rescue device according to claim 1, wherein the first ribbon member is hingedly connected by a first flap section attached to the brace member and the second ribbon member is hingedly connected by a second flap section attached to the brace member.

3. The rescue device according to claim 2, wherein the fastener comprises a hook and loop fastener.

4. The rescue device according to claim 1, wherein the fastener comprises a hook and loop fastener.

* * * * *